US005387286A

United States Patent [19]

Manor

[11] Patent Number: 5,387,286

[45] Date of Patent: Feb. 7, 1995

[54] TANK COATING APPARATUS AND METHOD

[75] Inventor: Arlington D. Manor, Orlando, Fla.

[73] Assignee: Modern Welding Company, Inc., Owensboro, Ky.

[21] Appl. No.: 116,904

[22] Filed: Sep. 3, 1993

[51] Int. Cl.[6] ..... B05C 13/00

[52] U.S. Cl. ..... 118/500; 118/305; 118/320; 118/323

[58] Field of Search ..... 118/305, 306, 320, 500, 118/323

[56] References Cited

U.S. PATENT DOCUMENTS

| | | | |
|---|---|---|---|
| 2,380,499 | 7/1945 | Brend | 91/44 |
| 3,581,922 | 6/1971 | Versoy et al. | 118/320 X |
| 3,659,550 | 5/1972 | Fulton | 118/52 X |
| 3,659,555 | 5/1972 | Malivoir | 118/320 |
| 3,670,696 | 6/1972 | Findley et al. | 118/320 |
| 3,999,507 | 12/1976 | Voermans | 118/320 X |
| 4,077,356 | 3/1978 | Andrews | 118/301 |
| 4,597,504 | 7/1986 | Witt | 220/88 R |
| 4,889,038 | 12/1989 | Bentivoglio | 92/110 |

*Primary Examiner*—David A. Simmons
*Assistant Examiner*—Paul M. Rivard
*Attorney, Agent, or Firm*—Allen, Dyer, Doppelt, Franjola & Milbrath

[57] ABSTRACT

An apparatus and method is provided for safely rotating large for apply flammable tank coating materials in a spark free environment. The tank is continuously rotated for drying while being relocated to a drying position permitting another tank to be brought to a position for the tank coating process. A hydraulic motor assembly is used to drive the apparatus in its rotational and relocation modes. A hose festooning array permits the continuous rotation and relocation of the rotating tanks while maintaining the safe environment. The hose festooning array provides automatic storage and distribution of the hose between the motor assembly and the remotely positioned pump. A chain driven by another hydraulic motor provides the driving force to reposition the tanks using a track system.

19 Claims, 4 Drawing Sheets

TANK COATING APPARATUS AND METHOD

BACKGROUND OF THE INVENTION

1. Field of Invention

The invention relates to an apparatus and method for safely positioning and rotating tanks for applying hazardous coating materials to the tanks and in particular to an apparatus and method for rotating and positioning such tanks while safely maintaining hydraulic operation for applying flammable coatings to the tank.

2. Description of Related Art

Various devices and methods have been used to rotate cylindrical structures and position them for the purpose of applying a coating to the structure and teach the use of hydraulic systems for driving such devices. U.S. Pat. No. 4,077,356 discloses a paint spray machine which includes a pair of housing members which are movable for positionally mounting cylindrical objects in a predetermined position. The cylindrical object to be painted is mounted in rotational displacement with respect to a multiplicity of rollers which extend from each of the housing members. Rotation of the rollers results in a counter rotation of the cylindrical object being painted. U.S. Pat. 3,581,922 discloses a method and apparatus for coating tubular objects such as pipe with epoxy resins wherein pipe sections are successively advanced in a train and continuously rotated through numerous operating stations. A pipe overhead suspension system coats an entire surface of the pipe and precludes damage to the pipe during curing and while it is in the critical fluid state. U.S. Pat. No. 3,659,550 discloses fluid operated coating and drying machine wherein all functions of the apparatus disclosed are accomplished by air-operated or other hydraulic methods controlled by valves actuated by an air operated circuit and in the complete absence of any electrical circuits, thereby avoiding any danger of explosion by ignition of flammable liquids which might be caused by an electrical spark.

Coating objects with hazardous materials presents the need for special handling of the materials and the objects which are to be coated. The present invention addresses the needs presented in applying tank coatings to large tanks and to the positioning of the tanks typically used in underground storage of hazardous materials.

SUMMARY OF INVENTION

The present invention provides a tank coating apparatus comprising means for rotatably supporting the tank and rotating the tank about an axis with supporting means adjustable for receiving tanks of varying dimensions. Means for rotating the tank communicates with the supporting means while using hydraulics for driving the rotating means. Means for moving the supporting means from a first position within an enclosed building to a second position outside the building is provided and means for delivering the hydraulics to the tank rotating means automatically maintains a position to continuously supply hydraulic pressure as the moving means passes from its first position to the second position.

In a preferred embodiment, the tank coating apparatus comprises a platform having means for moving the platform from a first position within a containment building to a second position outside the building. A carriage is movably affixed to the platform and has means for rotatably affixing the tank to the carriage. A fixture has means for rotatably affixing a tank to the fixture. A motor is affixed to the fixture for communicating with the rotatably affixed means between the carriage and the fixture. A hydraulic pump provides fluid through a hose for driving a hydraulic motor. The pump is located outboard of the platform and outside the containment building. A hose communicates between the pump and the motor through a fluid flow speed control valve. A hose festooning array has a first pulley separated from a second and third pulley. The pulley separation is used for storing excess hose. A hose carriage separated from the platform has the first pulley of the array rotatably affixed to the carriage. The second and third pulleys are rotatably affixed to the platform proximate the carriage. The first pulley communicates with the second and third pulleys through a portion of the hose passing over the pulleys. The carriage has a biasing means for biasing the carriage away from the platform for continuously maintaining the hose portion within the pulleys. The carriage moves from a position proximate the platform to a position distant the platform for accumulating excess hose portion as the platform moves away from and toward the pump.

A method for safely coating a tank with a highly flammable coating comprises the steps of providing a platform having a spindle and an idler for supporting a tank, affixing a tank between the spindle and the idler, the spindle and idler located on an axis of the tank, moving the platform to a first position within a containment building for applying a coating to the tank, rotating the tank about the axis, applying a coating to the rotating tank. Once coated, the platform is moved to a second position outside the building. A hydraulic motor assembly and hydraulic pump provide the driving forces to rotate the tank and relocate the tank to various selected positions. The pump is located at a safe distance from the platform for preventing electrical sparks generated at the pump from potentially igniting materials used in coating the tank. A length of hose is provided for carrying hydraulic fluid from the pump to the motor sufficient for positioning the platform at a first position within a containment building and again positioning the platform at a second position outside the containment building. The method continues by connecting the hose from the pump to the motor for driving the motor and providing a speed control valve between the pump and the motor, the control valve providing speed control to the motor. The spindle is driven with the motor. Pulleys are rotatably affixed to a hose carriage for receiving a portion of the hose. Multiple pulleys are affixed to the platform proximate the hose carriage for festooning a portion of the hose between the carriage pulleys and the platform multiple pulleys. The hose festooning biases the carriage to the platform. Providing a weight and pulley assembly having a cable affixed to the carriage biases the carriage away from the platform and maintains the hose portion within the pulley during movement of the platform from the first position to the second position.

The platform is moved from the first position to the second position outside the containment building for drying the coating at the second position. An elongated track having rails for receiving wheels rotatably affixed to the platform is used for rolling the platform along the track. By driving a continuously linked chain rotating around a point proximate the first position and a second point proximate the second position, and by providing a connection between the chain and the platform, the platform is moved from the first position to the second position.

In an alternate method, multiple tanks are rotated for coating by providing a central carriage having an idler for rotating a first tank at a first end of the idler and a second tank at a second end of the idler for rotating about a common axis of the idler and tanks. A first tank is affixed between the idler and the center carriage idler and a second tank between the center carriage idler and the spindle.

It is an object of the invention to be able to rotate large tanks for applying tank coatings in a safe environment free of potential fire or explosion caused by electrical sparks igniting the coating materials typically used in tank coating processes. It is a further object to be able to safely relocate the tank from a position where the coating takes place to another position where drying of the coating can take place while continuing to rotate the tank so that the coating dries where applied and while at its drying position place a second tank in position for the safe coating process. It is yet another object of the invention to be able to coat multiple small tanks.

BRIEF DESCRIPTION OF DRAWINGS

The above and other features and objects of the invention will be better understood from the following detailed description of the typical embodiment illustrated in the accompanying drawings, in which.

DETAILED DESCRIPTION OF PREFERRED EMBODIMENTS

A detailed description of the preferred and alternate embodiments of the invention will now be described with reference to FIGS. 1 through 9.

Figure 1:
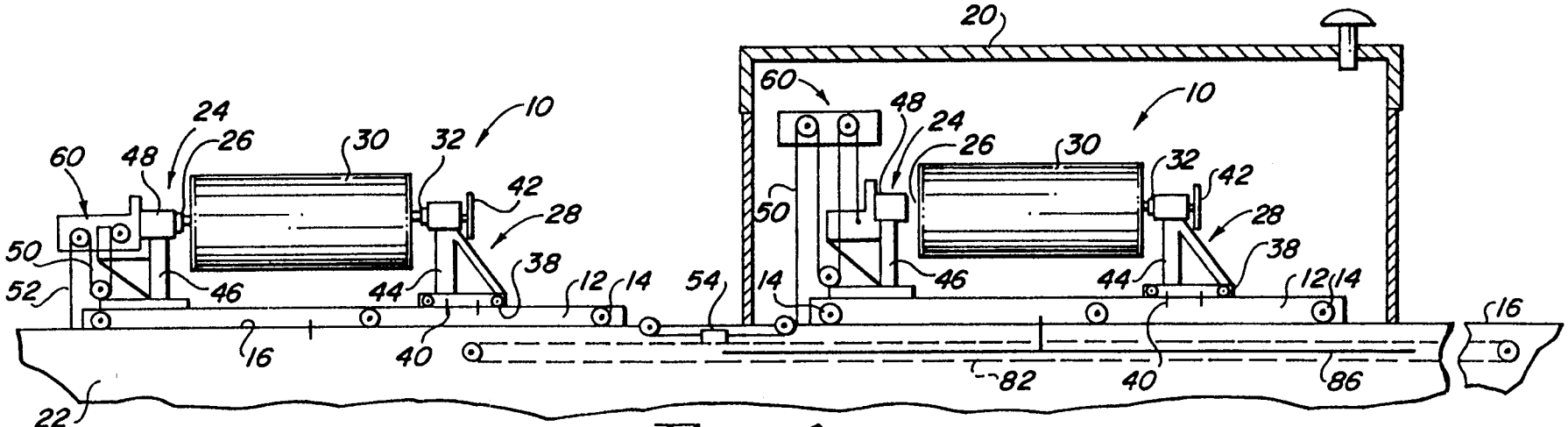
FIG. 1 is a partial elevation view of a preferred embodiment of the invention in which a tank affixed to the apparatus at a first position within a building for applying a tank coating and the same apparatus at a second position outside the building.

A preferred embodiment of the tank coating apparatus 10 as illustrated in FIG. 1 can be described as comprising a platform 12 having a plurality of wheels 14 rotatably affixed to the platform 12 for moving the platform 12 to various positions. In the preferred embodiment of the apparatus 10, the platform wheels 14 are arranged to communicate with rails of a track 16. The track 16 is positioned to locate the platform 12 from a first position 18 within a building 20 to a second position 22 outside the building 20.

Figure 2B:
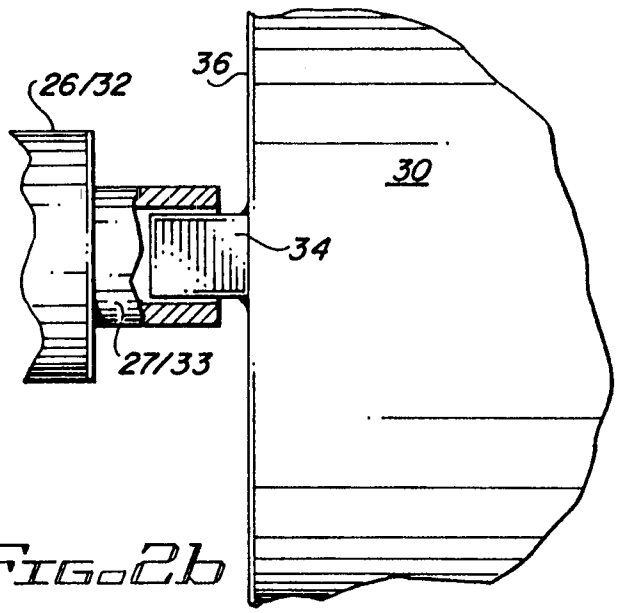
FIG. 2*b* is a partial cross-sectional side view of the extension of FIG. 2*a* rotatably affixed to an idler of the invention.
Figure 2A:
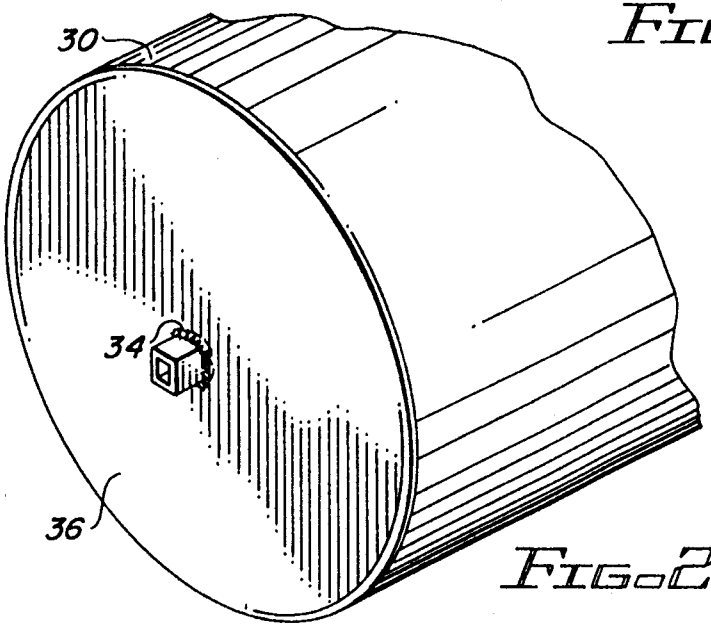
FIG. 2*a* is a partial perspective view of a tank having an extension affixed for being received by the invention.

A fixture 24 comprising a spindle 26 is affixed to the platform 12. A moveable carriage 28 is movably affixed to the platform 12 opposing the fixture 24 for receiving a tank 30. The carriage 28 comprises an idler 32. The tank 30 is rotatably affixed between the spindle 26 and the idler 32. Depending on the length of the tank 30, the moveable carriage 28 is adjusted along the platform 12 for receiving the tank 30. In the preferred embodiment, both the spindle 26 and the idler 32 have a pipe, 27 and 33 respectively, whose cross-section is a rectangle. A rectangular extension 34 is removably affixed to the tank faces 36, along a rotational axis of the tank 30. The extension 34 is also rectangular and sized for being received by the spindle pipe 27 and idler pipe 33 as illustrated in FIGS. 2*a* and 2*b*. In the preferred embodiment of the method disclosed, the extensions 34 is welded to the tank face 36 prior to the tank coating process. Once the tank 30 has been coated and allowed to dry, the extensions 34 are cut from the tank face 36 wherein the portion of the tank exposed is then coated after removal of the tank from the apparatus 10.

The moveable carriage 28 comprises bearing wheels 38 for improving movement along the platform 12 especially when the carriage 28 is under a load of the tank 30. Once the carriage 28 is positioned, carriage fastening means in the form of clamps 40 are used to affix the carriage 28 to the platform 12. The idler 32 further comprises an adjustable closure 42 which provides for additional adjustment along the axis of the tank 30. Both the carriage 28 and the fixture 24 further adjustable vertical members, 44 and 46 respectfully, for raising a rotating axis of a larger diameter tank 30. The adjustable features of the fixture 24 and the carriage 28 permit the apparatus 10 to accommodate the coating of a large variety of tank lengths and diameters.

The idler 32 is freely rotatable. The spindle 26 is driven by a motor and sprocket assembly 48 permitting freely driving the spindle 26 at varying speeds of rotation. The motor assembly is driven by hydraulics and speeds are varied using a hydraulic valve (not shown) placed in the hydraulic circuit proximate the motor assembly 48. The hydraulic motor assembly 48 is needed to ensure that spark generators such as an electrical motor are kept away from the tank coating material for avoiding hazardous conditions such as explosions and fires. Typically, a tank 30 having an eight foot diameter will be rotated such that the surface is traveling at approximately 100 feet per minute when fiberglass resin type coatings are being applied. Such a speed is sufficient to efficiently dry the coating without forcing the coating to fly off of the tank 30. In the preferred method of applying coating to a rotating tank 30, the rotation of the tank 30 is such that a worker applying the coating will be thrown away from the tank 30 should the worker inadvertently fall into the tank. With respect to the worker and his position next to the tank 30, a surface of the tank 30 is approaching the worker from the ground and moving up past a device for applying the coating.

Figure 3:
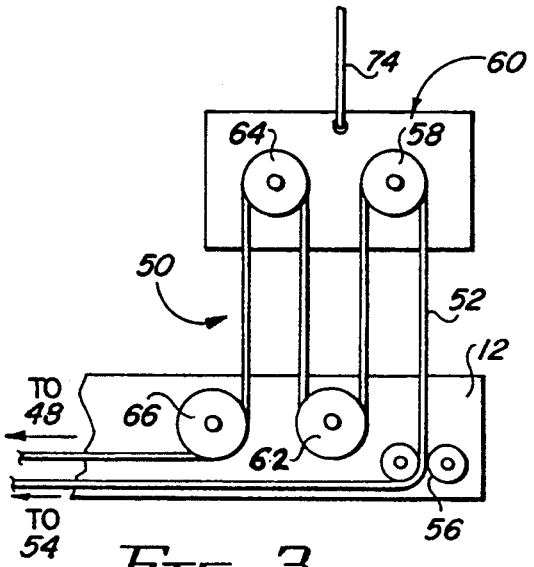
FIG. 3 is a partial elevation view of a hose festooning array in a preferred embodiment of the invention.
Figure 4:
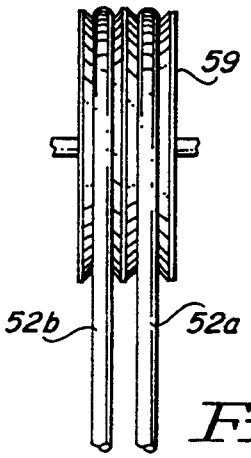
FIG. 4 is an end view of a double pulley illustrating an input and put hose configuration.

As is illustrated in FIG. 1 and further illustrated in FIGS. 3 through 6, the fixture 24 communicates with a hose festooning array 50 for storing a supply of flexible hose 52 needed between the motor assembly 48 and a hydraulic pump (not shown) providing the hydraulic fluids required to drive the motor assembly 48. Hydraulic pumps well known in the art are typically electrically driven. Some are by engines using combustible fuel such as gasoline or diesel fuel. In either case, the typical hydraulic pump provides a hazard especially if placed in the environment where typically flammable tank coating is applied. For safety reasons, it is necessary to isolate the pump and any potential spark generator that will be a source for igniting any tank coating materials used. In the preferred embodiment, the hydraulic pump is positioned outside the building 20 and out of any potentially hazardous area. In the preferred embodiment, a supply line (not shown) is brought to a position 54 proximate the track 16 where an end of the hose 52 is affixed. The hose 52 supplying the hydraulic fluid from that position 54 from the pump to the motor assembly 48. As is illustrated in FIG. 3. the hose 52 is passed between a pulley pair 56 rotatably affixed to the platform 12. In the preferred embodiment, the pulley pair 56 is rotatably affixed to the platform 12 at a position proximate the fixture 24. The hose 52 is threaded through a plurality of pulleys in the festooning array 50 between the pulley pair 56 and the motor assembly 48. The number of pulleys will vary depending upon the amount of hose 52 to be stored. In the preferred embodiment and as illustrated here by way of example, reference to pulleys is in fact a double pulley arrangement 59 to account for a hydraulic circuit that comprises input hose 52*a* that runs from the pump to the motor assembly 48 and that portion of hose 52*b* that returns to the pump from the motor assembly 48 as is illustrated in FIG. 4. In one embodiment, a first pulley 58 is rotatably affixed to a pulley carriage 60. A second pulley 62 is rotatably affixed to the platform 12 opposing the first pulley 58 for communicating with the first pulley 58. The pulley carriage 60 is movably biased away from the platform 12 to allow the pulley carriage 60 to move away from the platform 12 when additional hose 52 needs to be stored. Increasing amounts of hose 52 will need to be stored in the festooning array 50 as the motor assembly 48 is brought closer to the hose end fixed position 54. In the preferred embodiment illustrated in FIG. 3, a third pulley 64 is rotatably affixed to the pulley carriage 60 and a fourth pulley 66 is rotatably affixed to the platform 12 for providing additional storage for the festooning array 50. As additional pulleys are added, the movement of the pulley carriage 60 away from and toward the platform 12 is lessened.

Figure 5A:
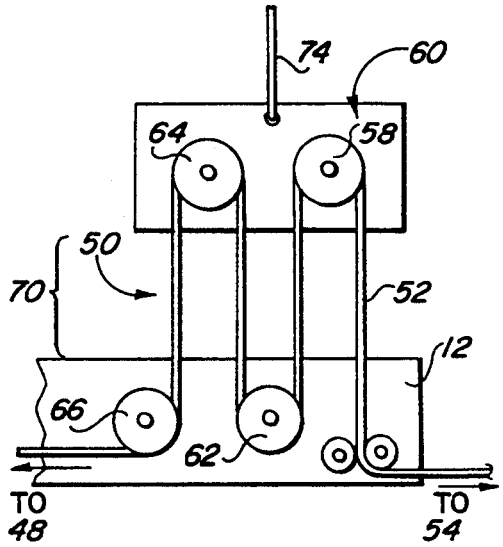
FIG. 5*a* is a partial elevation view of the hose festooning array illustrating a position of a pulley carriage at a shortened distance to a platform for the platform at a second position.
Figure 5B:
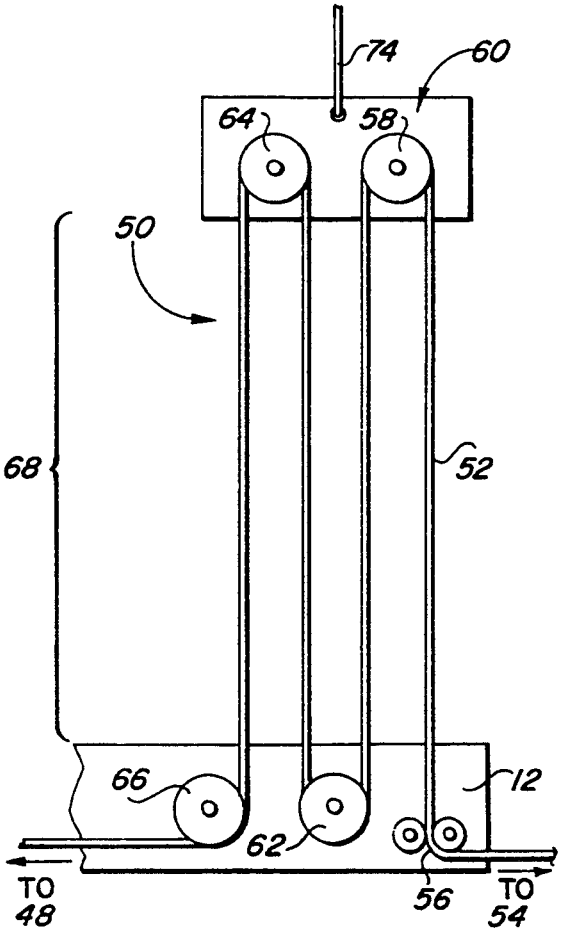
FIG. 5*b* is a partial elevation view of the hose festooning array illustrating a position of the pulley carriage at an expanded distance from the platform for storing additional hose while at a first position.

Again with reference to FIG. 1, by way of example, the apparatus 10 is shown in the first position 18 inside the building 20 and in the second position 22 outside the building 20. In the example, the hose fixed position 54 is close to the building 20 and as such requires that the pulley carriage 60 be brought away from the platform 12 to an extended position 68 to accommodate the storage of hose 52 as further illustrated in FIG. 5*b*. When the platform 12 is brought outside the building 20 to the second position 22, the pulley carriage 60 is brought proximate the platform 12 to a shortened position 70 as illustrated in FIG. 5*a* because the hose 52 is needed to account for the increased distance from the motor assembly 48 to the hose fixed position 54 that the second position 22 places the motor assembly 48 as compared to the first position 18.

Figure 6:
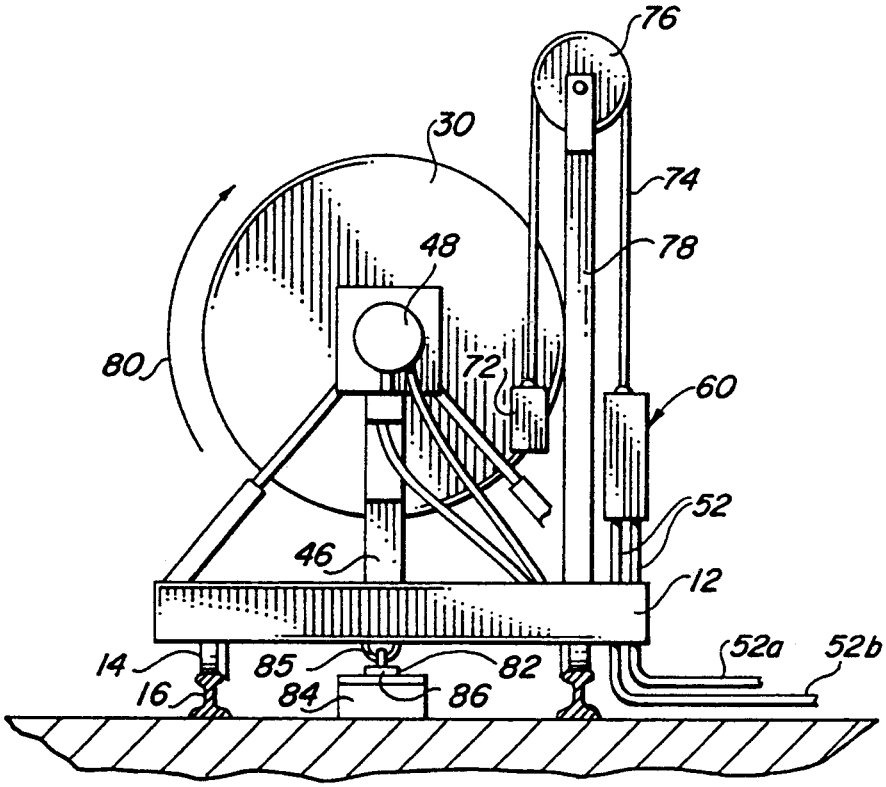
FIG. 6 is a partial end view of the preferred embodiment of the invention illustrating a portion of the invention comprising the hose festooning array.

In the preferred embodiment, the pulley carriage 60 is movably biased away from the platform 12 using a counter weight 72 acting against the pulley carriage 60 using a cable 74 traveling over a pulley 76 affixed to an end of an arm member 78 whose other end is affixed to the platform 12 as is illustrated in FIG. 6.

Again with reference to FIG. 6, as discussed earlier, the rotation 80 as indicated by the arrows, will be such to throw a worker away from the rotating tank 30. Such a worker operating with the illustrated apparatus 10 of FIG. 6 would be applying tank coating from the side of the tank 30 opposite the carriage pulley 60.

The platform 12 is moved from the first position 18 to the second position 22 along the track 16 using a driven chain 82 that travels in a continuous loop within a channel 84. A hook 85 is removably affixed between the chain 84 and the platform 12 for communicating chain movement to the platform 12. The chain is also driven by a hydraulic motor (not shown) to maintain a safe condition for operation of the motor in the hazardous environment. To further guard against sparks, a conductive channel liner 86 is affixed within the channel 84 as least in the that portion of the channel 84 that passes within the building 20 as illustrated in FIGS. 1 and 6.

Figure 7:
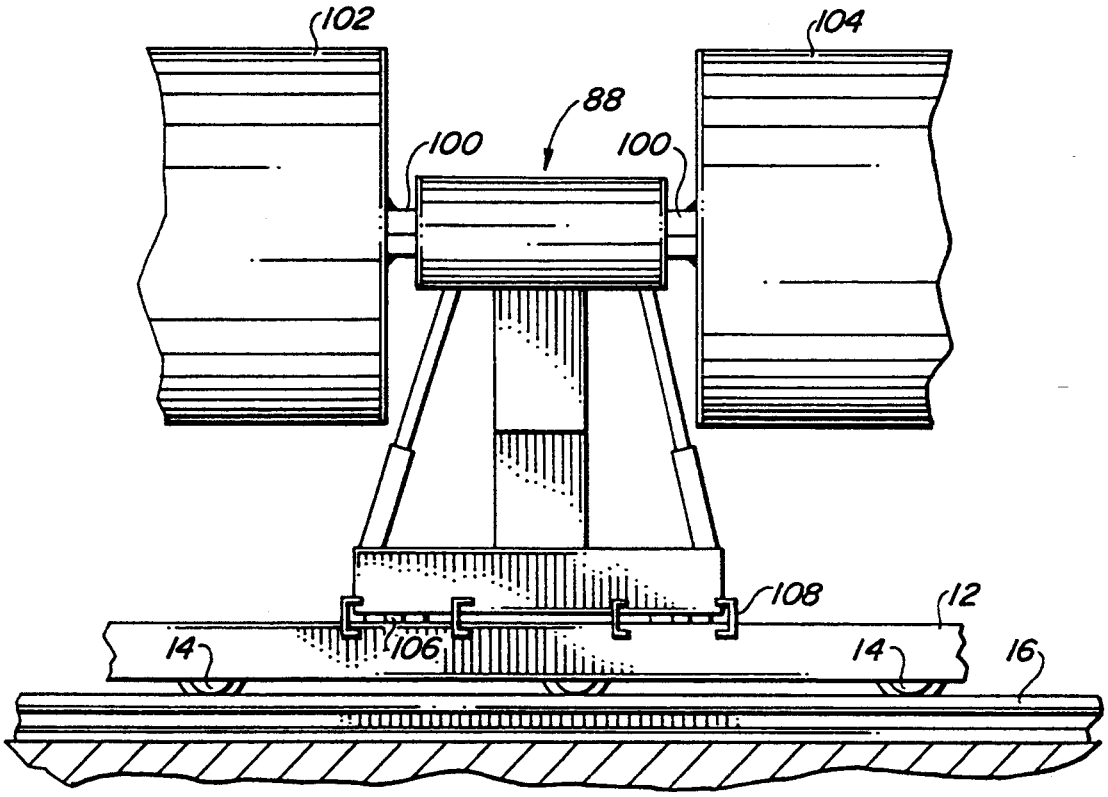
FIG. 7 is a partial elevation view of a central carriage for use with the invention while rotatably affixing two tanks on the apparatus.

Rather than coat small tanks individually, with an additional embodiment of the invention, it is possible to rotatably affix two tanks between the fixture 24 and the movable carriage 28 by movably affixing a central movable carriage 88 on the platform 12 at a location between the fixture 12 and the movable carriage 28 so as to accommodate the two smaller tanks. As is illustrated in FIG. 7, the central carriage 88 comprises a central idler 100 for affixing to extensions 34 affixed to end faces of a first small tank 102 and a second small tank 104. As does the movable carriage 28, the central carriage 88 is adjustable to account for tank sizes and comprises bearing wheels 106 for moving the central carriage 88 along the platform 12 when positioning tanks as well as a clamp 108 for affixing the central carriage 88 once the tanks 102 and 104 have been affixed.

Figure 8A:
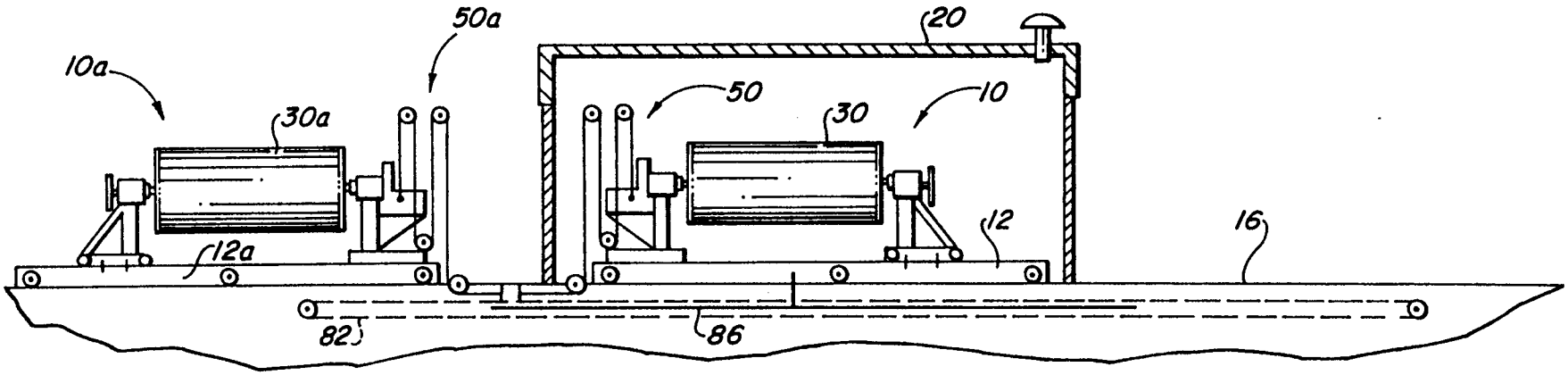
FIG. 8*a* is an elevation view of an embodiment the invention wherein a first apparatus and a second apparatus are use in combination, the first apparatus positioned within a building for applying a tank coating and the second apparatus positioned outside the building.
Figure 8B:
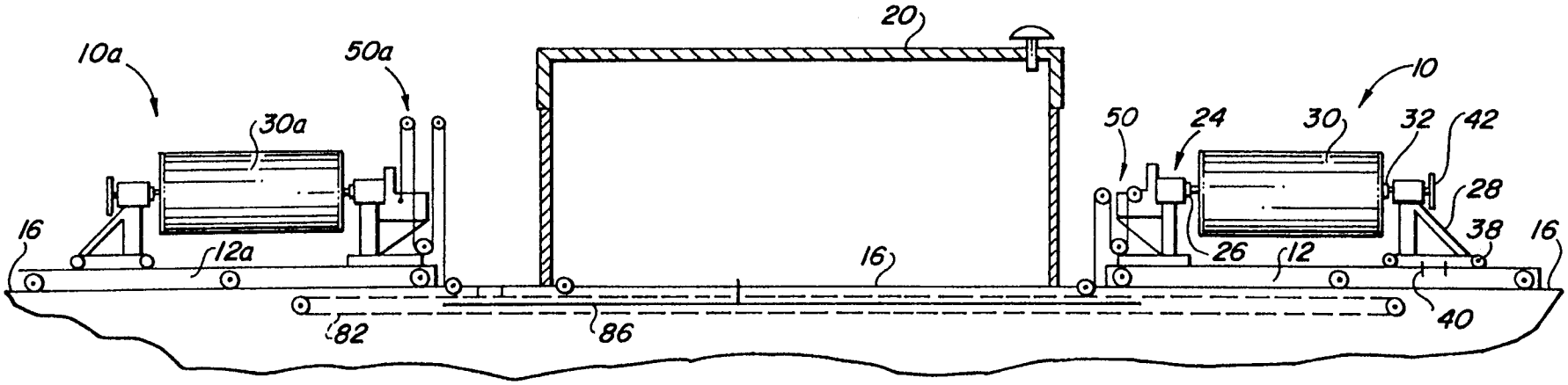
FIG. 8*b* is an elevation view as in FIG. 9*a* wherein both the first apparatus and second apparatus are positioned outside the building.

As is illustrated in FIGS. 8*a* and 8*b*, and as is configured for the preferred embodiment of the invention, the apparatus 10 is used with a second apparatus 10*a*. In such an arrangement, the platforms 12 and 12*a* are placed on the track 16 with the festooning arrays 50 and 50*a* facing each other. A manifold (not shown) is used to provide a second hose 52*a* from the hose fixed position 54. The operation of each apparatus 10 and 10*a* are maneuvered and operated as earlier described for a single apparatus 10. Track 16 is extended to position the platforms 12 and 12*a* on both sides of the building 20. With such an arrangement, two tanks 30 and 30*a* can be affixed for tank coating. One tank 30 can be positioned within the building 20 as illustrated in FIG. 8*a*, while the other tank 3O*b* is being affixed onto the second platform 12*a* outside the building 20. Once coated, the first tank 30 can be allowed to dry outside the building 20 while the second tank 30*a* is prepared for movement to within the building 20 as illustrated in FIG. 8*b*. Because of the hose festooning arrays 50 and 50*a*, the tanks 30 and 30*a* can be rotated at any location of the platforms 12 and 12*a*.

What is claimed is:

1. A tank coating apparatus comprising:

means for rotatably supporting a tank, for rotation about an axis of the tank, said supporting means adjustable for receiving tanks of varying dimensions;

means for rotating the tank, the rotating means communicating with the supporting means, the rotating means using hydraulics for driving the rotating means;

means for moving the supporting means from a first position within an enclosed building to a second position outside the building; and means for delivering the hydraulics to the tank rotating means, the delivery means automatically maintaining a position to continuously supply hydraulic pressure as the moving means passes from its first position to the second position, the delivery means including means cooperating with the moving means for taking up excess hose as the moving means passes from the first position within the enclosed building to the second position outside the building.

2. The tank coating apparatus as recited in claim 1, wherein the means cooperating with the hydraulic delivery means comprises:

a hose for passing hydraulic fluid through a pressurized system through a hydraulically driven motor, the hose having a first end for communicating with an input to the motor and a second end for communicating with an output of the motor, the motor used in the tank rotating means;

a platform having the rotating means affixed thereto;

a movable pulley carriage having a first pulley rotatably affixed to the carriage, the first pulley receiving the hose;

a second pulley rotatably affixed to the platform, the second pulley communicating with the first pulley for receiving the hose and delivering the hose to the motor;

a third pulley rotatably affixed to the platform, the third pulley communicating with the first pulley for receiving the hose and delivering the hose to the pump.

3. The tank coating apparatus as recited in claim 1 further comprising means for rotatably supporting a second tank, the second tank supporting means communicating with the tank rotating means through the tank affixed between the second tank supporting means and the tank rotating means.

4. The tank coating apparatus as recited in claim 1, wherein the moving means comprises:

a platform having wheels dimensioned to roll over rails of a track;

a track having rails for receiving the wheels; and a driven chain, the chain removably affixed to the platform for locating the platform from the first position to the second position.

5. The tank coating apparatus as recited in claim 1 wherein the rotatably supporting means comprises:

a fixture having a rotatable spindle, the spindle dimensioned to be affixed to a tank fitting for supporting the tank;

a movable carriage slidably adapted to be affixed to a platform, the carriage having locking means for affixing the carriage to the platform; and an idler rotatably affixed to the carriage, the idler dimensioned to be affixed to a tank second fitting for supporting the tank, the idler and spindle on an axis, the axis coinciding with an axis of a tank rotating about the axis for receiving a tank coating.

6. The tank coating apparatus as recited in claim 5, wherein the spindle further comprises a rectangular pipe dimensioned for closely receiving a rectangular extension, the extension affixed to a tank end wall on an axis of the tank.

7. A tank coating apparatus comprising:

a platform;

means for moving the platform from a first position within a containment building to a second position outside the building;

a carriage movably affixed to the platform;

means for rotatably affixing one end of a tank to the carriage;

a fixture;

means for rotatably affixing a second end of the tank to the fixture;

a motor affixed to the fixture, the motor communicating with the rotatably affixing means for rotating the tank affixed between the carriage and the fixture;

a hydraulic pump useful in providing fluid through a hose for driving a hydraulic motor, the pump located outboard of the platform and at a safe position outside the containment building;

a hose communicating between the pump and the motor through a fluid flow control valve, the control valve useful in establishing a preferred speed and direction of rotation for the tank;

a hose festooning array, the array having a first pulley separated from second and third pulleys, the pulley separation useful in storing excess hose; and a hose carriage separated from the platform, the first pulley of the array rotatably affixed to the hose carriage, the second and third pulleys rotatably affixed to the platform proximate the hose carriage, the first pulley communicating with the second and third pulley through a portion of the hose passing over the pulleys, the hose carriage having biasing means for biasing the hose carriage away from the platform for continuously maintaining the hose portion within the pulleys, the hose carriage moving from a position proximate the platform to a position distant the platform for accumulating excess hose portion as the platform moves from the first position within the containment building to the second position outside the building.

8. The tank coating apparatus as recited in claim 7 wherein the moving means comprises:

platform wheels rotatably affixed to the platform, the wheels dimensioned for riding rails;

a track having rails for receiving the platform wheels;

a driven chain passing below the platform for affixing to the platform when moving the platform from the first position to the second position;

a chain channel extending from a location proximate the first position to a location proximate the second position, the channel receiving the driven chain;

means for driving the chain; and means for affixing the chain to the platform.

9. The tank coating apparatus as recited in claim 8, wherein the chain channel further comprises a conductive channel liner, the liner providing an electrical lead to a ground for conducting electrical sparks caused by the driven chain to the ground.

10. The tank coating apparatus as recited in claim 7, wherein the carriage further comprises:

a base positioned for movement on the platform;

carriage wheels rotatably affixed to the base for communicating with the platform; and locking means affixed to the base, the locking means communicating with the platform for affixing the base to the platform.

11. The tank coating apparatus as recited in claim 7 further comprising a second carriage movably affixed to the platform between the carriage and the fixture, the second carriage having communicating opposing idlers, the opposing idlers on the axis of the idler and spindle, the second carriage positioned for receiving a first tank between carriage idler and the second carriage idler and receiving a second tank between the second carriage opposing idler and the fixture spindle, the fixture motor driving the spindle, the spindle driving the idler through tanks rotatable affixed to the idlers and spindle.

12. The tank coating apparatus as recited in claim 7 wherein the hose festooning array comprises multiple pulleys, the multiple pulleys apportioned between the hose carriage and platform for receiving extended hose lengths, the extended hose lengths useful in extending a distance between the platform first position and second position.

13. A tank coating apparatus as recited in claim 7 wherein the carriage biasing means comprises:

an elongated arm member having a first end affixed to the platform and a second end suspended above the platform;

a pulley rotatably affixed to the arm member second end;

a weight sufficient to counter balance the hose carriage in combination with the pulleys affixed to the hose carriage and the hose portion communicating the carriage;

a cable having a first end affixed to the weight and a second end affixed to the hose carriage, the cable passing over the pulley rotatably affixed to the arm member second end, the cable moving over the pulley in response to the weight biasing the hose carriage away from the platform and holding the hose portion in its festooned array.

14. A tank coating system, comprising:

an elongated platform having a first end and a second end, the platform having a plurality of wheels, the wheels dimensioned to rotate over a track;

a carriage movably affixed to the platform first end, the carriage having an adjustable idler for rotatably affixing one end of a tank;

a fixture affixed to the platform second end, the fixture having a spindle for rotating an opposing end of the tank about an axis of rotation of the tank;

a hydraulic motor affixed to the fixture, the motor communicating with the spindle through a sprocket assembly for driving the spindle;

a hydraulic pump for communicating with the motor through pressurized hydraulic fluid passing through the motor, the pump affixed outboard and distance from the platform;

hydraulic hose connected from the pump to the motor;

means for holding the hose in an adjustable festooned array, the array providing storage for excess hose when the platform is moved from the first position inside the building to the second position outside the building;

a control value affixed between the pump and motor for controlling the fluid flow through the motor and thus a rotation of the spindle;

means for adjusting locations of the spindle and idler, the locations selected for rotation of various tank sizes;

an elongated track having rails configured to receive the platform wheels, the track extended for moving the platform from a first position within a containment building to a second position outside the building; and means for driving the platform from first position within an enclosed building to the second position outside the building.

15. The tank coating system as recited in claim 14, wherein the driving means comprises:

a chain rotatably between the first and second positions;

means for affixing the platform to the chain; and means for driving the chain.

16. The tank coating system as recited in claim 14 wherein the hose holding means comprises:

a hose carriage separated from the platform, the hose carriage having a first pulley rotatably affixed to the hose carriage for receiving the hose;

a second pulley affixed to the platform, the second pulley receiving a portion of the hose;

a third pulley affixed to the platform, the third pulley receiving another portion of the hose;

the first pulley biased away from the second and third pulleys for holding the hose portions in the festooned array during movement of the platform from the first position to the second position; and means for biasing the first pulley away from the second and third pulleys, the biasing means responsive to the movement of the platform from the first position within the containment building to the second position outside the building.

17. The tank coating system as recited in claim 16, wherein the biasing means comprises:

an elongated arm member having a first end affixed to the platform and a second end suspended above the platform;

a pulley rotatably affixed to the arm member second end;

a weight sufficient to counter balance the hose carriage in combination with the pulleys affixed to the hose carriage and the hose portion communicating the hose carriage; and a cable having a first end affixed to the weight and a second end affixed to the hose carriage, the cable passing over the pulley rotatably affixed to the arm member second end, the cable moving over the pulley in response to the weight biasing the hose carriage away from the platform and holding the hose portion in its festooned array.

18. A tank coating apparatus comprising:

means for rotatably supporting a tank;

means for rotating the tank, the rotating means including a hydraulically driven motor;

means for moving the supporting means from a first position within an enclosed building to a second position outside the building; and means including hydraulic hose for delivering hydraulic fluid to the motor, the delivery means including means cooperating with the moving means for taking up excess hose in a festooning array, the array providing storage for the excess hose as the moving means passes from position to position, the festooning array forming generally parallel hose portions.

19. The tank coating apparatus as recited in claim 22, wherein the cooperating means comprises a pulley carriage having at least one pulley within the array, the pulley carriage biased away from remaining pulleys within the array for separating the pulley carriage and thus the pulley carriage pulley for taking up excess hose between the pulley carriage pulley and the remaining pulleys.

* * * * *